US006362722B1

(12) United States Patent
Cole et al.

(10) Patent No.: US 6,362,722 B1
(45) Date of Patent: Mar. 26, 2002

(54) CURRENT LIMITING DEVICE WITH ELECTRICALLY CONDUCTIVE COMPOSITE AND METHOD OF MANUFACTURING THE ELECTRICALLY CONDUCTIVE COMPOSITE

(75) Inventors: Herbert Stanley Cole; Theresa Ann Sitnik-Nieters, both of Burnt Hills; Anil Raj Duggal, Niskayuna, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/709,880

(22) Filed: Nov. 13, 2000

Related U.S. Application Data

(62) Division of application No. 08/896,874, filed on Jul. 21, 1997, now Pat. No. 6,191,681.

(51) Int. Cl.[7] ..... H01C 7/10

(52) U.S. Cl. ..... 338/22 R; 338/20; 252/511; 29/610.1

(58) Field of Search ..... 338/20, 21, 22 R, 338/225 D, 47; 252/511, 512, 510

(56) References Cited

U.S. PATENT DOCUMENTS

| | | | | | |
|---|---|---|---|---|---|
| 4,780,371 | A | * | 10/1988 | Joseph et al. | 428/414 |
| 5,313,184 | A | | 5/1994 | Grueter et al. | |
| 5,378,407 | A | * | 1/1995 | Chandler et al. | 252/513 |
| 5,382,938 | A | | 1/1995 | Hansson et al. | |
| 5,614,881 | A | | 3/1997 | Duggal et al. | |
| 5,912,308 | A | * | 6/1999 | Das et al. | 525/480 |
| 6,191,681 | B1 | * | 2/2001 | Cole et al. | 338/22 R |

FOREIGN PATENT DOCUMENTS

| | | |
|---|---|---|
| EP | 0640995 | 6/1997 |

* cited by examiner

*Primary Examiner*—Lincoln Donovan
*Assistant Examiner*—Kyung S. Lee
(74) *Attorney, Agent, or Firm*—Toan P. Vo; Noreen C. Johnson

(57) ABSTRACT

A current limiting device utilizes an electrically conductive composite material and an inhomogeneous distribution of resistance structure. The electrically conductive composite material comprises an organic binder portion comprising a high Tg epoxy and a low viscosity polyglycol epoxy; at least one epoxy curing agent; and a conductive powder.

12 Claims, 2 Drawing Sheets

CURRENT LIMITING DEVICE WITH ELECTRICALLY CONDUCTIVE COMPOSITE AND METHOD OF MANUFACTURING THE ELECTRICALLY CONDUCTIVE COMPOSITE

This application is a division of application Ser. No. 08/896,874 filed Jul. 21, 1997, now a U.S. Pat. No. 6,191,681 which is hereby incorporated by reference in its entirety.

BACKGROUND OF THE INVENTION

1. Field of the Invention

This invention relates to current limiting devices for general circuit protection including electrical distribution and motor control applications. In particular, the invention relates to current limiting devices that are capable of limiting the current in a circuit when a high current event or high current condition occurs.

2. Description of Related Art

There are numerous devices that are capable of limiting the current in a circuit when a high current condition occurs. One known limiting device includes a filled polymer material that exhibits what is commonly referred to as a PTCR (positive-temperature coefficient of resistance) or PTC effect. U. S. Pat. Nos. 5,382,938, 5,313,184, and European Published Patent Application No. 0,640,995 A1 each describes electrical devices relying on PTC behavior. The unique attribute of the PTCR or PTC effect is that at a certain switch temperature the PTCR material undergoes a transformation from a basically conductive material to a basically resistive material. In some of these prior current limiting devices, the PTCR material (typically polyethylene loaded with carbon black) is placed between pressure contact electrodes.

U.S. Pat. No. 5,614,881, to Duggal et al., issued Mar. 25, 1997, the entire contents of which are herein incorporated by reference, discloses a current limiting device. This current limiting device relies on a composite material and an inhomogeneous distribution of resistance structure.

Current limiting devices are used in many applications to protect sensitive components in an electrical circuit from high fault currents. Applications range from low voltage and low current electrical circuits to high voltage and high current electrical distribution systems. An important requirement for many applications is a fast current limiting response time, alternately known as switching time, to minimize the peak fault current that develops.

In operation, current limiting devices are placed in a circuit to be protected. Under normal circuit conditions, the current limiting device is in a highly conducting state. When a high current condition occurs, the PTCR material heats up through resistive heating until the temperature is above the "switch temperature." At this point, the PTCR material resistance changes to a high resistance state and the high current condition current is limited. When the high current condition is cleared, the current limiting device cools down over a time period, which may be a long time period, to below the switch temperature and returns to the highly conducting state. In the highly conducting state, the current limiting device is again capable of switching to the high resistance state in response to future high current condition events.

Known current limiting devices comprise electrodes, electrically conductive composite material, a low pyrolysis or vaporization temperature polymeric binder and an electrically conducting filler, combined with an inhomogeneous distribution of resistance structure. The switching action of these current limiting devices occurs when joule heating of the electrically conducting filler in the relatively higher resistance part of the composite material causes sufficient heating to cause pyrolysis or vaporization of the binder.

During operation of known current limiting devices, at least one of material ablation and arcing occur at localized switching regions in the inhomogeneous distribution of resistance structure. The ablation and arcing can lead to at least one of high mechanical and thermal stresses on the conductive composite material. These high mechanical and thermal stresses often lead to the mechanical failure of the composite material.

Further, electrically conductive composite materials that have been used in known current limiting devices are often quite brittle, and may fracture during high voltage and high current events. Also, there is often little reproducibility in electrically conductive composite material batches, which have been previously used in current limiting devices. Accordingly, the characteristics of electrically conductive composites in current limiting devices vary, and may adversely effect the operation and reliability of operation of the current limiting device.

One such composite material, previously attempted for use in current limiting devices is Epotek N30 (Epoxy Technologies Inc.), a commercially available epoxy. Epotek N30 is filled with nickel particles to provide electrical conductivity. Several batches Epotek were tested, and some of the batches were found to give good electrical performance. However, there was little or no reproducibility from batch to batch of Epotek N30. Further, the Epotek N30 batches were quite brittle, thus resulting in fracture during testing.

Therefore, electrically conductive composite materials for use in current limiting devices should possess desirable, constant and reproducible electrical and mechanical properties, which are suitable for high current multiple use current polymer limiting devices. These electrical and mechanical properties include, but are not limited to desirable current limiting device properties, such as a low initial contact resistance, high switch resistance, switching times that are less than a few milli-seconds, and also mechanical toughness and durability.

SUMMARY OF THE INVENTION

Accordingly, it is desirable to provide a quick, reusable current limiting device, where the current limiting device overcomes the above noted, and other, disadvantages of the related art.

It is further desirable to provide a current limiting device, where the composite material possesses desirable electrical and mechanical properties suitable for a multiple use current polymer limiting device. These electrical and mechanical properties include, but are not limited to, low initial contact resistance, high switch resistance, switching times that are less than a few milli-seconds and mechanical toughness and durability so that the polymer current limiting device has multiple use capability.

It is also desirable to provide a high current multiple use current limiting device. The device comprises at least two electrodes; an electrically conducting composite material between said electrodes; interfaces between said electrodes and said composite material; an inhomogeneous distribution of resistance at said interfaces whereby, during a high current event, adiabatic resistive heating at said interfaces causes rapid thermal expansion and vaporization of the binder resulting in at least a partial physical separation at said interfaces; and means for exerting compressive pressure on said composite material. The electrically conductive composite material comprises an organic binder portion having a high Tg epoxy and a low viscosity polyglycol epoxy; at least one epoxy curing agent; and a conductive powder.

Further, it is desirable to provide an electrically conductive composite and method of manufacture of the electrically conductive composite, where the electrically conductive composite material comprises an organic binder portion having a high Tg epoxy and a low viscosity polyglycol epoxy; at least one epoxy curing agent; and a conductive powder These and other advantages and salient features of the invention will become apparent from the following detailed description, which, when taken in conjunction with the annexed drawings, disclose preferred embodiments of the invention.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE EMBODIMENTS

A current limiting device, as embodied by the invention, comprises an electrically conductive composite material positioned between electrodes, so that there is an inhomogeneous distribution of resistance throughout the current limiting device. The electrically conductive composite material comprises at least a conductive filler and an organic binder. The current limiting device, as embodied by the invention, further comprises means for exerting compressive pressure on the electrically conductive composite material of the current limiting device.

To be a reusable current limiting device, the inhomogeneous resistance distribution is arranged so at least one thin layer of the current limiting device is positioned perpendicular to the direction of current flow, and has a higher resistance than the average resistance for an average layer of the same size and orientation in the device. In addition, the current limiting device is under compressive pressure in a direction perpendicular to the selected thin high resistance layer. The compressive pressure may be inherent in the current limiting device or exerted by a resilient structure, assembly or device, such as but not limited to a spring.

In operation, the current limiting device, as embodied by the invention, is placed in the electrical circuit to be protected. During normal operation, the resistance of the current limiting device is low, i.e., in this example the resistance of the current limiting device would be equal to the resistance of the electrically conductive composite material plus the resistance of the electrodes plus the contact resistance. When a high current event or high current event occurs, a high current density starts to flow through the current limiting device. In initial stages of the short circuit or high current event, the resistive heating of the current limiting device is believed to be adiabatic. Thus, it is believed that the selected thin, more resistive layer of the current limiting device heats up much faster than the remainder of the current limiting device. With a properly designed thin layer, it is believed that the thin layer heats up so quickly that thermal expansion of and/or gas evolution from the thin layer causes a separation within the current limiting device at the thin layer.

Figure 1:
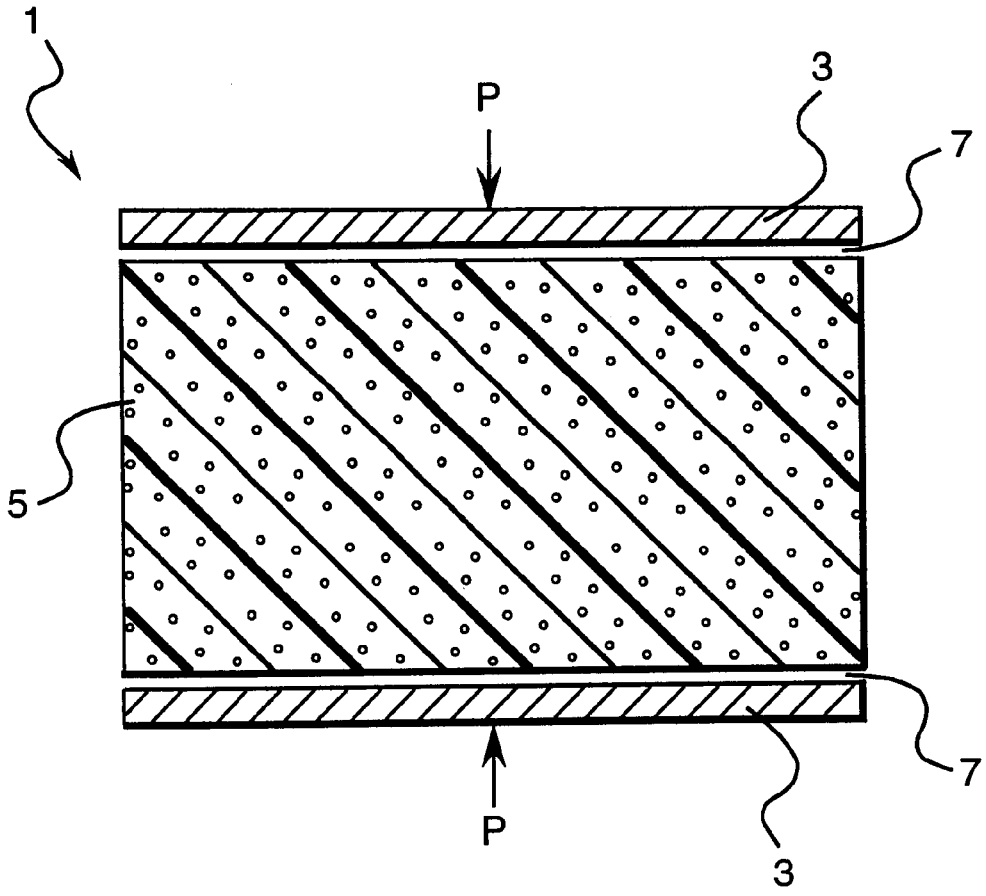
FIG. 1 is a schematic representation of a current limiting device, as embodied by the invention.
Figure 2:
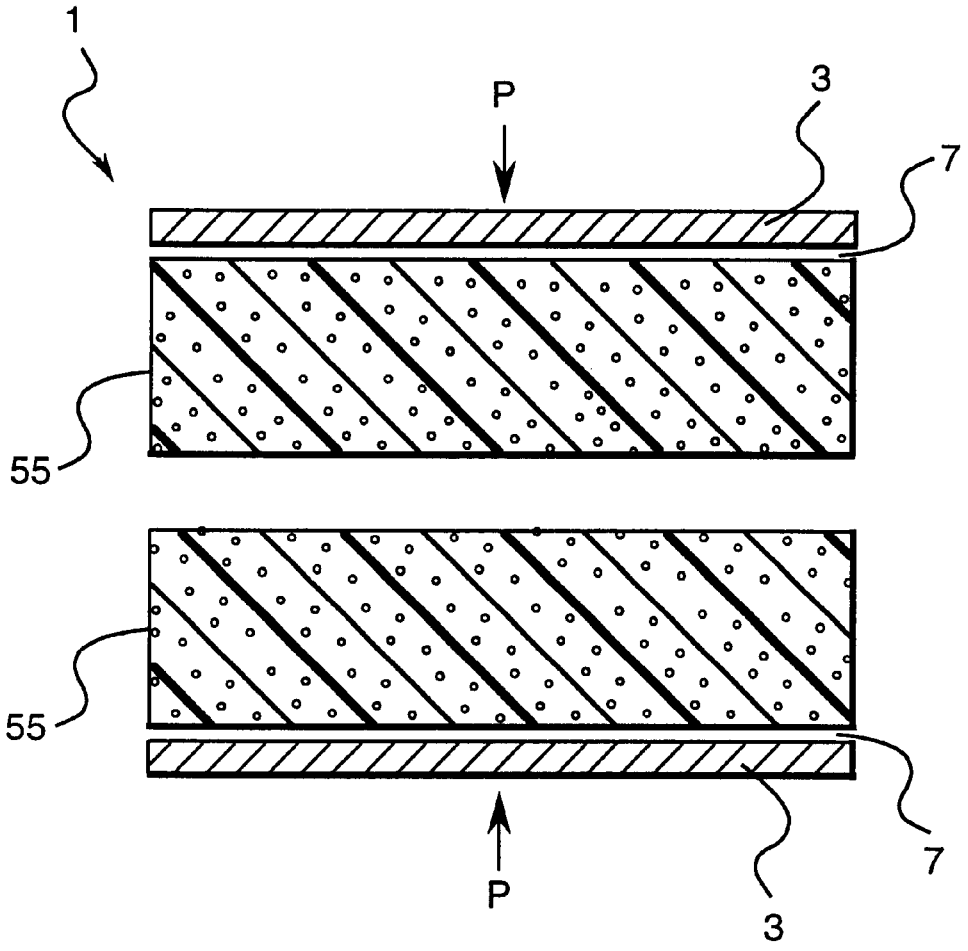
FIG. 2 is a schematic representation of a further current limiting device, as embodied by the invention.

The invention, as illustrated in FIG. 1, comprises a high current multiple use fast-acting current limiting device 1. In FIG. 1, the current limiting device 1, as embodied by the invention, comprises electrodes 3 and an electrically conductive composite material 5 with inhomogeneous distributions 7 of resistance structure under compressive pressure P. However, the scope of the invention includes a high current multiple use current limiting device with any suitable construction where a higher resistance is anywhere between the electrodes 3. For example, the higher resistance may be between two composite materials 55 in the high current multiple use current limiting device, as illustrated in FIG. 2. However, this is merely exemplary and is not meant to limit the invention in any way.

The binder should be chosen such that significant gas evolution occurs at a low (about approximately <800° C.) temperature. The inhomogeneous distribution structure is typically chosen so that at least one selected thin layer of the current limiting device has much higher resistance than the rest of the current limiting device.

The inhomogeneous distribution of resistance in the electrically conductive composite is arranged so that at least one thin layer positioned perpendicular to the direction of current flow has a predetermined resistance, which is at least about ten percent (10%) greater than an average resistance for an average layer of the same size and orientation. Further, inhomogeneous distribution of resistance is positioned proximate to at least one electrode electrically conductive composite material interface.

It is believed that the advantageous results of the invention are obtained because, during a high current event, adiabatic resistive heating of the thin layer followed by rapid thermal expansion and gas evolution from the binding material in the high current multiple use current limiting device. This rapid thermal expansion and gas evolution lead to a partial or complete physical separation of the current limiting device at the selected thin layer, and produce a higher over-all device resistance to electric current flow. Therefore, the current limiting device limits the flow of current through the current path.

When the high current event is cleared externally, it is believed that the current limiting device regains its low resistance state due to the compressive pressure built into the current limiting device allowing thereby electrical current to flow normally. The current limiting device, as embodied by the invention, is reusable for many such high current event conditions, depending upon such factors, among others, as the severity and duration of each high current event.

In a current limiting device, as embodied by the invention, it is believed that the vaporization and/or ablation of the composite material causes a partial or complete physical separation at the area of high resistance, for example the electrode/material interface. In this separated state, it is believed that ablation of the composite material occurs and arcing between the separated layers of the current limiting device can occur. However, the overall resistance in the separated state is much higher than in the nonseparated state. This high arc resistance is believed due to the high pressure generated at the interface by the gas evolution from the composite binder combined with the deionizing properties of the gas. In any event, the current limiting device of the present invention is effective in limiting the high current event current so that the other components of the circuit are not harmed by the high current event.

After the high current event is interrupted, it is believed that the current limiting device returns or reforms into its non-separated state, due to compressive pressure, which acts to push the separated layers together. It is believed that once the layers of the current limiting device have returned to the non-separated state or the low resistance state, the current limiting device is fully operational for future current-limiting operations in response to other high current event conductors.

Alternate embodiments of the current limiting device of the present invention can be made by employing a parallel current path containing a resistor, varistor, or other linear or nonlinear elements to achieve goals such as controlling the maximum voltage that may appear across the current limiting device in a particular circuit or to provide an alternative path for some of the circuit energy in order to increase the usable lifetime of the current limiting device.

The electrically conductive composite material for use in the current limiting device, as embodied by the invention, comprises at least four constituents. Three of the at least four constituents are found in an organic binder portion of the electrically conductive composite. In particular, the three constituents in the organic binder portion of the electrically conductive composite comprise a high Tg epoxy, a low viscosity polyglycol epoxy and at least one curing agent. The other of the at least four constituents comprise a conductive powder.

Therefore, as embodied in the invention, the current limiting device includes a composite material that provides desired electrical and mechanical properties for use in high current multiple use current limiting devices. The desirable electrical and mechanical properties include, but are not limited to, low initial contact resistance, high switch resistance associated with a high current event, fast switching times, and mechanical toughness and durability for multiple use capability.

For example, the low initial contact resistance, for an exemplary current limiting device as embodied by the invention, is in the order of about 0.05 ohm, for a current limiting device, as embodied by the invention. The high switch resistance associated with a high current event is in the order of about 50 ohms or more. Further, switching times, for a current limiting device as embodied by the invention, are on an order of about less than a few milliseconds.

As embodied by the invention, an electrically conducting composite comprises high Tg epoxy resins combined up to about 30% by weight of low viscosity polyglycol epoxy resins. A conductive powder, such as but not limited to, fine nickel powder is blended into the organic binder, along with at least one curing agent to form the electrically conductive composite. Polymer current limiting devices, as embodied by the invention, fabricated from these electrically conductive composites result in enhanced and improved electrical performance.

A high Tg epoxy, for use in the organic binder portion of the electrically conductive composite for a current limiting device as embodied by the invention, is provided in a range of at least about 70% by weight of the organic binder portion of the electrically conductive composite. The high Tg epoxy preferably comprises a high Tg epoxy, such as, but not limited to novolac or a bisphenol A structure.

Low viscosity polyglycol epoxy forms the remaining portion of the organic binder portion of the electrically conductive composite, as embodied in the invention. The low viscosity polyglycol provides flexibility to the high Tg epoxy. Accordingly, the low viscosity polyglycol epoxy comprises up to about 30% by weight of the organic binder portion of the electrically conductive composite, for a current limiting device as embodied by the invention.

Several different types of curing agents are used with epoxies in the electrically conductive, for a current limiting device as embodied by the invention. The curing agents comprise, but are not limited to known curing agents for epoxies, such as acids, amines, anhydrides, free radical initiators and other curing agents. For example, a curing agent in the form of a latent heat catalyst was found to provide excellent curing of the epoxy at elevated temperatures. In particular, a curing agent comprising a lewis acid catalyst, such as boron tri-chloride or boron trifluoride amine complexes, was added at about 4% by weight of epoxy to the electrically conductive composite. These catalysts do not trigger epoxy curing until temperatures of approximately about 150° C. were reached. Thus, it was possible to formulate and store the materials for forming the electrically conductive composite, for a current limiting device as embodied by the invention, at room temperatures for extended time periods.

The fourth ingredient in the electrically conductive composite, as embodied by the invention, is a conductive powder. The conductive powder permits current to flow through the electrically conductive composite. The conductive powder is preferably, but not limited to, a fine nickel powder, for example such as but not limited to Ni 255 air classified fines Ni powder, commercially available from Novamet Corporation. The nickel powder is preferably added in a concentration in a range between about 55% to about 70% by weight of the total sample weight of the electrically conductive composite, including the organic binder portion. The size, geometry, surface area, and morphology of the nickel powder are important to performance of a current limiting device, as embodied by the invention.

In particular, a nickel powder with an average particle size (Fisher size) of about 2 um was determined to provide desirable performance and characteristics for the electrically conductive composite in a current limiting device, as embodied by the invention. Moreover, nickel particles possessing a surface area of about 0.75 $m^2/g$ and an apparent density of about 0.9 g/cc further enhance performance of a current limiting device, as embodied by the invention.

To better illustrate the improved performance of a current limiting device with the electrically conductive composite, for a current limiting device as embodied by the invention, samples of electrically conductive composites were prepared and tested. The following examples and test results in the Tables illustrate the desirable characteristics and properties of the electrically conductive composite, as embodied by the invention. However, the following are merely examples, and are not meant to limit the invention in any way. The measurements, quantities and other quantifications in the following description are approximate. The percents set forth below are weight percent, unless specified otherwise. The times are in msec and the resistances are in ohms.

EXAMPLE 1

A current limiting device, as embodied by the invention, was prepared initially using a stock epoxy solution, as the organic binder portion of the electrically conductive composite. The stock epoxy solution was prepared by blending about 96g of a novolac epoxy (EPN1139 from Ciba Geigy Corp.) and about 4 g of a boron trichloride amine complex (DY9577 from Ciba Geigy Corp.), as latent heat catalyst. Blends were then made from this stock epoxy solution containing either 10%, about 20%, and about 30% by weight of a polyglycol low viscosity flexibilizer (DER 736 from Dow Chemical Corp.). These resultant blends, which contained about 10%, about 20%, and about 30% flexibilizer, were then blended with a Ni powder, which was used for the conductive powder. The Ni powder concentrations were about 55%, about 60%, and about 65% of a total weight of the electrically conductive composite when blended with different epoxy solutions above.

The electrically conductive composite was thoroughly mixed and placed, as samples, in approximately ¾inch diameter by approximately ⅛inches thick cavities fabricated in TEFLON© substrates. The cavities were completely filled with the electrically conductive composite, and covered with a TEFLON© top plate. The samples were baked for about 1 ½hr. at about 150° C. The resultant cured nickel and epoxy electrically conductive composite discs were removed, and tested for electrical performance.

The nickel and epoxy electrically conductive composite discs were tested for electrical performance by placing nickel and epoxy electrically conductive composite discs between two electrodes, as a current limiting device as embodied by the invention. The current limiting device was held in place with a moderate pressure. A high current pulse or high current event was applied to the electrodes and nickel and epoxy electrically conductive composite discs. The electrical characteristics of the current limiting device were then measured. An initial resistance, a switch time to reach a high resistance state, a switch resistance, and number of reuse pulses before failure were recorded. The results are set forth below in Table 1:

TABLE 1

| Sample | Avg Ri | Avg SW t | Avg R | #pulses |
|---|---|---|---|---|
| 10% flexibilizer | | | | |
| 55% Ni | 1.3 | 0.07 | 249 | 11 |
| 60% Ni | 0.1 | 0.23 | 104 | 9 |
| 65% Ni | 0.05 | 1.35 | 97 | 6 |
| 20% flexibilizer | | | | |
| 55% Ni | 10.2 | 0.14 | 455 | 5 |
| 60% Ni | 0.23 | 0.11 | 249 | 15 |
| 65% Ni | 0.03 | 1.4 | 107 | 9 |
| 30% flexibilizer | | | | |
| 55% Ni | 0.49 | 0.11 | 259 | 13 |
| 60% Ni | 0.05 | 0.97 | 86 | 4 |
| 65% Ni | 0.03 | 2.35 | 59 | 3 |

The results of the tests performed on an electrically conductive composite of Example 1, set forth above, indicate that these constituents for an electrically conductive composite provide desired electrical and other properties in a high current multi-use current limiting device. Moreover, the results set forth above in Example 1 further illustrate that an electrically conductive composite with the constituents set forth above, as embodied by the invention, provide desired electrical and other properties in high current multiple use current limiting devices. Additional experiments were conducted with a different lewis acid curing agent, boron tri-fluoride mono-ethyl- amine complex. Results similar to that using boron trichloride amine complex, discussed above, were obtained.

However, to confirm that the constituents and compositions set forth in Example 1 are conclusive, and provide desirable results for a high current multiple use current limiting device, further tests were conducted.

EXAMPLE 2

Example 2 was conducted, in a similar manner to Example 1, however Example 2 used samples with epoxies and nickel powders other than those listed above in Example 1. The Example 2 samples, which relied upon different constituents were prepared and measured as described above in Example 1, and the results is summarized below in Table 2:

TABLE 2

| Sample | Avg Ri | Avg SWt | Avg R | # Pulses |
|---|---|---|---|---|
| Commercial | 0.03 | 3 | 7 | 1 |
| Ni/epoxy N30 | 0.08 | 1.8 | 2 | 1 |
| | 0.36 | 3.0 | 5 | 1 |
| | 0.27 | 2.0 | 32 | 1 |
| | 0.05 | 2.33 | 33 | 3 |
| 65% Ni 255 without separation of coarse powder with a 30% flexibilzer | 0.04 | 2.2 | 5 | 1 |
| 55% Ni fine in Norland Optical Adhesive (a urethane/acrylic based adhesive system) | 195 | 0.5 | 0.88 | 2 |
| 65% Ni fine in Norland Optical Adhesive (a urethane/acrylic based adhesive system) | 0.05 | 2.24 | 1.2 | 1 |
| 55% Ni fine in CY-179 (a cycloaliphatic epoxy) | 0.38 | discs fractured during test | | |
| 65% Ni fine in Ricon epoxy (an epoxidized butadiene system) | discs too soft to measure | | | |
| 65% Ni fine in OE-100, novolac with imidazole cure | 0.07 | 1.68 | 16 | 2 |

Accordingly, based on the results in Example 2, not only nickel powder as a constituent in a electrically conductive composite material is important in providing satisfactory results for an electrically conductive composite in a high current multiple use current limiting device, a proper size of the nickel powder is also important in providing satisfactory results for an electrically conductive composite in a high current multiple use current limiting device, as embodied by the invention. Therefore, it has been discovered that a nickel powder, such as but not limited to nickel 255 air classified fines, as the conductive powder is desirable in an electrically conductive composite, as embodied by the invention. Further, it has been determined that there are certain polymers or epoxy blends that will not provide desired electrical and physical performance in an electrically conductive composite for a current limiting device.

EXAMPLE 3

In Example 3, electrically conductive composites, as embodied by the invention, were formulated using bisphenol A epoxy, as a constituent in the organic binder portion of the electrically conductive composite. According to further tests using an electrically conductive composite set forth below, it was further determined that there is at least one other class of epoxy compounds that result in excellent electrical performance of an electrically conductive composite in a high current multiple use current limiting device, as embodied by the invention. These epoxies are set forth below in Example 3.

In Example 3, about 4% by weight of DY9577, a latent heat catalyst is blended with Epon 828, a bisphenol A epoxy (Dow Chemical), as the organic binder portion of the an electrically conductive composite. To this combination of DY9577 and Epon 828, samples, about 10% and about 20% by weight of DER 736 polyglycol low viscosity flexibilizer, as a curing agent was added. Various amounts of Ni 255 air classified fines Ni powder, as a conductive powder, were also added. Samples were prepared and tested, as discussed above. The results are summarized below in Table 3.

TABLE 3

| Sample | Avg Ri | Avg SW t | Avg R | # pulses |
|---|---|---|---|---|
| 10% flexibilizer | | | | |
| 60% Ni fines | 0.03 | 0.8 | 34 | 4 |
| 65% Ni fines | 0.02 | 2.1 | 18 | 3 |
| 20% flexibilizer | | | | |
| 60% Ni fines | 0.05 | 0.4 | 121 | 8 |
| 65% Ni fines | 0.02 | 2.3 | 24 | 3 |

Based on the results for Example 3, an electrically conductive composite in a current limiting device, as embodied by the invention, comprising a combination of a high Tg epoxy, a lewis acid catalyst, a flexibilizer, and fine nickel powder having an appropriate structure, provides a current limiting device with desirable and suitable characteristics for high current multiple use applications.

Example 4–6, as set forth below, discuss further constituents and compositions for an electrically conductive composite, with a high concentration of flexibilizer. These Examples also describe alternate processing parameters for an electrically conductive composite, as embodied by the invention.

EXAMPLE 4

In Example 4, a relatively long chain aliphatic, such as but not limited to, low viscosity flexibilizer, 732, is added to an EPON 828 and DY 9577 mixture, such as discussed above in Example 3, for the electrically conductive composite. Nickel powder is used as a conductive powder in Example 4 in the form of air classified fines. Various concentrations of the constituents in a were prepared and tested. The results are set forth below in Table 4:

TABLE 4

| Sample | Avg Ri | Avg Swt | Avg R | # Pulses |
|---|---|---|---|---|
| 20% Flexibilizer | | | | |
| 65% Ni fine | 0.03 | 1.97 | 148 | 7 |
| 30% Flexibilizer | | | | |
| 60% Ni fine | 0.09 | 0.23 | 349 | 7 |
| 65% Ni fine | 0.03 | 3.7 | 198 | 6 |
| 65% Ni fine | 0.05 | 1.43 | 317 | 7 |
| 40% Flexibilizer | | | | |
| 60% Ni fine | 0.04 | 2.63 | 364 | 4 |
| 50% Flexibilizer | | | | |
| 65% Ni fine | 0.1 | 0.57 | 666 | 9 |

EXAMPLE 5

In Example 5, the EPON 828 and DY9577 mixture, as discussed above, was prepared, for the electrically conductive composite. However, different processing equipment was used in the cure cycle to determine appropriate manufacturing equipment and processes. The processing equipment includes equipment, such as, but not limited to, a laminator, press, and autoclave. The samples are then prepared using a 732 flexibilizer, as set forth above, and 65% nickel fine powder with differing equipment. The results are set forth below in Table 5:

TABLE 5

| Equipment/ Sample | Avg Ri | Avg Sw t | Avg R | # Pulses |
|---|---|---|---|---|
| Laminator | | | | |
| 40% flex | 0.03 | 0.72 | 123 | 9 |
| 50% flex | 0.02 | 1.11 | 229 | 9 |
| Press | | | | |
| 40% flex | 0.04 | 0.54 | 233 | 9 |
| 50% flex | 0.03 | 1.15 | 417 | 6 |
| 50% flex | 0.03 | 1.52 | 182 | 6 |
| Autoclave | | | | |
| 40% flex | 0.02 | 1.188 | 56.5 | 8 |
| 40% flex | 0.027 | 1.28 | 114 | 5 |
| 40% flex | 0.027 | 1.084 | 148.8 | 5 |

EXAMPLE 6

In Example 6, the electrically conductive composite is mixed using a SEMCO© automatic mixer. Previously, the samples of electrically conductive composite were mixed by hand. For this Example 6, the mixture to prepare the electrically conductive composite material comprised EPON 828 with DY9577, and 40% 732 with 65% Nickel fine powder. Test results of Example 6 are set forth below in Table 6:

TABLE 6

| Sample | Avg Ri | Avg Sw t | Avg R | # Pulses |
|---|---|---|---|---|
| Semco mixer | 0.0233 | 1.24 | 92 | 9 |

The data in the Tables above are provided for a current limiting device with a constant size, where both the electrically conductive composite material size and electrode size are constant. Further, in the Tables above, the high current pulse is also maintained at a constant level, which allows for a meaningful comparison.

Examples 4–6 illustrate that an electrically conductive composite comprising a flexibilizer, in various concentrations, is suitable and desirable for use in a high current multiple use current limiting device, as embodied by the invention. Further, Examples 4–6 also illustrate that different curing processes and equipment, such as but not limited to, lamination, pressing, and autoclaving, as well as a machine mixing process, for example with a SEMCO mixer, provide desirable and suitable characteristics for an electrically conductive composite material in a high voltage multiple use current limiting device, as embodied by the invention.

While the embodiments described herein are preferred, it will be appreciated from the specification that various combinations of elements, variations or improvements therein may be made by those skilled in the are that are within the scope of the invention.

What is claimed is:

1. An electrically conductive composite consisting essentially of:

(1) an organic binder portion consisting essentially of:
(a) a first liquid epoxy resin selected from the group consisting of novolac epoxy, bisphenol-A-based epoxy, and mixtures thereof;
(b) a second liquid polyglycol epoxy; and
(c) at least one epoxy curing agent; and
(2) a conductive powder.

2. The composite according to claim 1, where the conductive powder comprises nickel powder.

3. The composite according to claim 1, wherein the first liquid epoxy resin of the organic binder portion is present in an amount of greater than 50% by weight of the organic binder portion and the polyglycol epoxy of the organic binder portion is present in an amount of less than 50% by weight of the organic binder portion.

4. The composite according to claim 1, wherein the at least one epoxy curing agent is selected from the group consisting of: acids, amines, anhydrides, and free radical initiators.

5. The composite according to claim 1, wherein the at least one epoxy curing agent comprises lewis acid catalyst.

6. The composite according to claim 1, wherein the at least one epoxy curing agent is present in an amount of less than 10% by weight of the electrically conductive composite.

7. The composite according to claim 1, wherein the conductive powder is present in an amount between 50% and 70% by weight of the electrically conductive composite.

8. The composite according to claim 1, wherein the conductive powder comprises nickel powder, the nickel powder possessing an average particle surface area of about 0.75 $m^2/g$.

9. The composite according to claim 1, wherein the polyglycol epoxy is a polyglycol epoxy flexibilizer, the polyglycol epoxy flexibilizer being present in an amount less than 50% by weight of the organic binder portion.

10. A method of manufacturing an electrically conductive composite, the method comprising the steps of:

(1) preparing an epoxy solution consisting essentially of an organic binder portion consisting essentially of:
(a) a first liquid epoxy resin selected from the group consisting of novolac epoxy, bisphenol-A-based epoxy, and mixtures thereof; and
(b) a second liquid polyglycol epoxy;

(2) adding at least one epoxy curing agent and a conductive powder into the epoxy solution to form a mixture; and (3) processing the mixture in at least one equipment selected from the group consisting of a laminator, a press, a mixer, and an autoclave.

11. The method according to claim 10, wherein the step of adding the at least one epoxy curing agent and the conductive powder into the epoxy solution comprises mixing the at least one epoxy curing agent and the conductive powder into the epoxy solution.

12. The method according to claim 11, wherein the mixing is one of mixing by hand and mixing by a machine.

* * * * *